US005183980A

United States Patent [19]

Okuma et al.

[11] Patent Number: 5,183,980

[45] Date of Patent: Feb. 2, 1993

[54] LINEAR MOTOR ELEVATOR DEVICE WITH A NULL-FLUX POSITION ADJUSTMENT

[75] Inventors: Shigeru Okuma; Takeshi Furuhashi, both of Nagoya; Hiroyuki Ikejima; Toshiaki Ishii, both of Inazawa, all of Japan

[73] Assignee: Mitsubishi Denki Kabushiki Kaisha, Tokyo, Japan

[21] Appl. No.: 707,342

[22] Filed: May 29, 1991

[30] Foreign Application Priority Data

Jun. 1, 1990 [JP] Japan ..... 2-143537

[51] Int. Cl.[5] ..... B66B 1/06

[52] U.S. Cl. ..... 187/112; 187/94

[58] Field of Search ..... 187/110, 112, 1 R; 318/135, 366, 369; 104/290

[56] References Cited

U.S. PATENT DOCUMENTS

| | | | |
|---|---|---|---|
| 3,701,321 | 10/1972 | Lee | 104/290 |
| 3,802,349 | 4/1974 | Guimbal | 318/135 |
| 3,891,907 | 6/1975 | Lenzkes et al. | 318/369 |
| 4,402,386 | 9/1983 | Ficheux et al. | 187/112 |
| 4,570,753 | 2/1986 | Ohta et al. | 187/1 R |
| 5,033,588 | 7/1991 | Nakai et al. | 187/95 |
| 5,090,516 | 2/1992 | Grinaski et al. | 187/112 |

*Primary Examiner*—A. D. Pellinen
*Assistant Examiner*—Lawrence E. Colbert
*Attorney, Agent, or Firm*—Leydig, Voit & Mayer

[57] ABSTRACT

A linear motor elevator includes: a multitude of primary side coils mounted on the hoist way along the whole hoist path, and vertical columns of permanent magnets constituting the secondary side magnets mounted on the elevator car. The polarity of the permanent magnets alternate both horizontally across the columns and vertically along respective columns. When the elevator car is displaced horizontally in a direction perpendicular to the hoisting direction of the elevator car, a circulating current producing a magnetic flux that counterbalances the variation of the flux caused by the displacement flows through each primary side coils opposing the permanent magnets on the elevator car. Thus, the position of the elevator car within the hoist way is automatically adjusted in accordance with the null-flux method.

4 Claims, 4 Drawing Sheets

LINEAR MOTOR ELEVATOR DEVICE WITH A NULL-FLUX POSITION ADJUSTMENT

BACKGROUND OF THE INVENTION

This invention relates to linear motor elevator devices by which a elevator car or a hoisted body is hoisted up and down within a shaft or hoist way by means of a linear synchronous motor.

FIG. 1 is a perspective view showing a conventional ropeless linear motor elevators. On the interior side walls of a hoist way 1 are mounted a multitude of primary side coils 2, each horizontal layer (row) of which is divided into four coils 2*a* through 2*d*. A pair of rails 3 are attached to the respective interior side walls of the hoist way 1, and a hoisted body or an elevator car 4 having mounted on the side walls thereof a plurality of permanent magnets 5 as the primary side magnets of the linear synchronous motor is guided along the rails 3 by means of guide rollers 6 rolling on the rails 3. Each horizontal layer (row) of the permanent magnets 5 is divided into four magnets 5*a* through 5*d* which oppose the four coils 2*a* through 2*d* of the primary side coils 2, respectively. A braking device 7 stops the elevator car 4 by means of a braking shoe when the elevator car 4 arrives at the destination floor 8.

The operation of the linear motor elevator of FIG. 1 is as follows. In response to a start command signal, the braking device 7 is released and the primary side coils 2 are excited by means of a converter such as VVVF device (not shown) to generate a vertically moving magnetic field. Thus, a thrust or driving force is generated on the elevator car 4 by means of the linear synchronous motor consisting of the primary side coils 2 and the permanent magnets 5, such that the elevator car 4 is hoisted up or down along the hoist way 1 to the destination floor 8. When the elevator car 4 arrives at the destination floor 8, the excitation current supplied from the converter to the primary side coils 2 is interrupted and the elevator car 4 is stopped by the braking device 7.

The above conventional device has the following disadvantage. In addition to the thrust force along the Z-axis, there are generated between the primary side coils 2 and permanent magnets 5 attractive forces along the Y-axis. Further, when the elevator car 4 is slanted, for example, a lateral force along the X-axis is generated in addition. Thus, in order to maintain proper constant gaps between the primary side coils 2 and the permanent magnets 5 while guiding the elevator car 4, the rails 3 and the guide rollers 6 must have enough mechanical strength to support such attractive or lateral forces.

SUMMARY OF THE INVENTION

It is therefore an object of this invention to provide a linear motor elevator by which the mechanical strength of the rails and the guide rollers can be safely reduced or, more preferably, the rails and the guide rollers can altogether be dispensed with.

The above objects are accomplished in accordance with the principle of this invention by a linear motor elevator device for hoisting a hoisted body up and down within a hoist way by means of a linear motor, which comprises: primary side coils of a linear motor mounted on a side wall of said hoist way along a hoist path of the hoisted body, the primary side coils generating a magnetic field moving along the hoist way; and secondary side magnets of the linear motor attached to a side of said hoisted body to oppose said primary side coils across a gap, whereby said moving magnetic field generated by the primary side coils drive said hoisted body within the hoist way; wherein upon displacement of the hoisted body along a direction perpendicular to a hoisting direction of the hoisted body a circulating current which counterbalances a variation of magnetic flux caused by the displacement of the hoisted body flows through said primary side coils, thereby automatically adjusting a position of the hoisted body along said direction perpendicular to the driving direction.

BRIEF DESCRIPTION OF THE DRAWINGS

The features which are believed to be characteristic of this invention are set forth with particularity in the appended claims. The structure and method of operation of this invention itself, however, will be best understood from the following detailed description, taken in conjunction with the accompanying drawings, in which:

In the drawings, like reference numerals represent like or corresponding parts or portions.

DETAILED DESCRIPTION OF THE PREFERRED EMBODIMENTS

Figure 1:
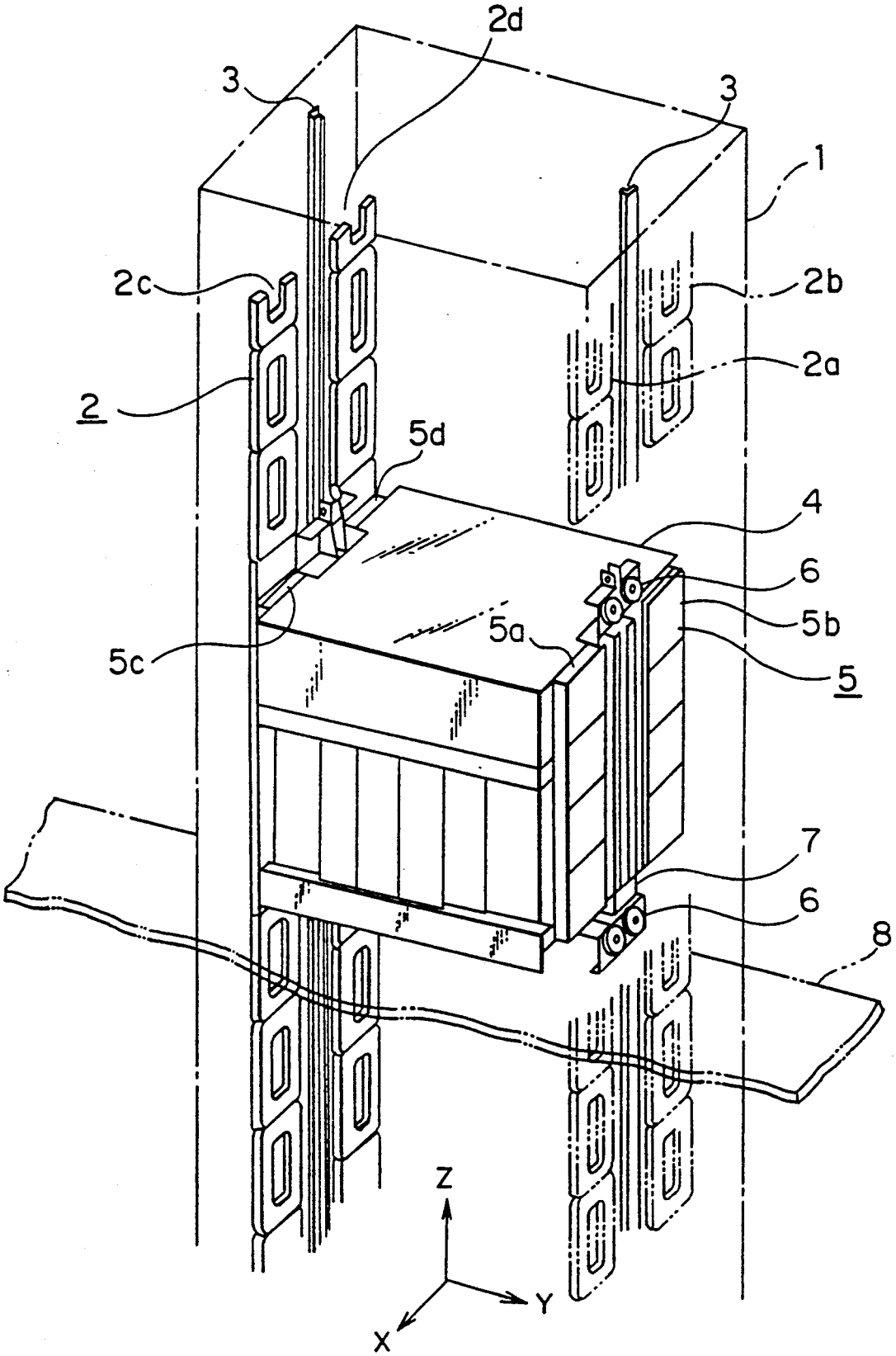
FIG. 1 PRIOR ART
FIG. 1 is a schematic perspective view of a conventional ropeless linear motor elevator.

Referring now to the accompanying drawings, the preferred embodiments of this invention are described. In what follows, the parts identical or corresponding to those of the linear motor elevator of FIG. 1 are generally designated by the same reference numerals, and the description thereof may be omitted.

Figure 2:
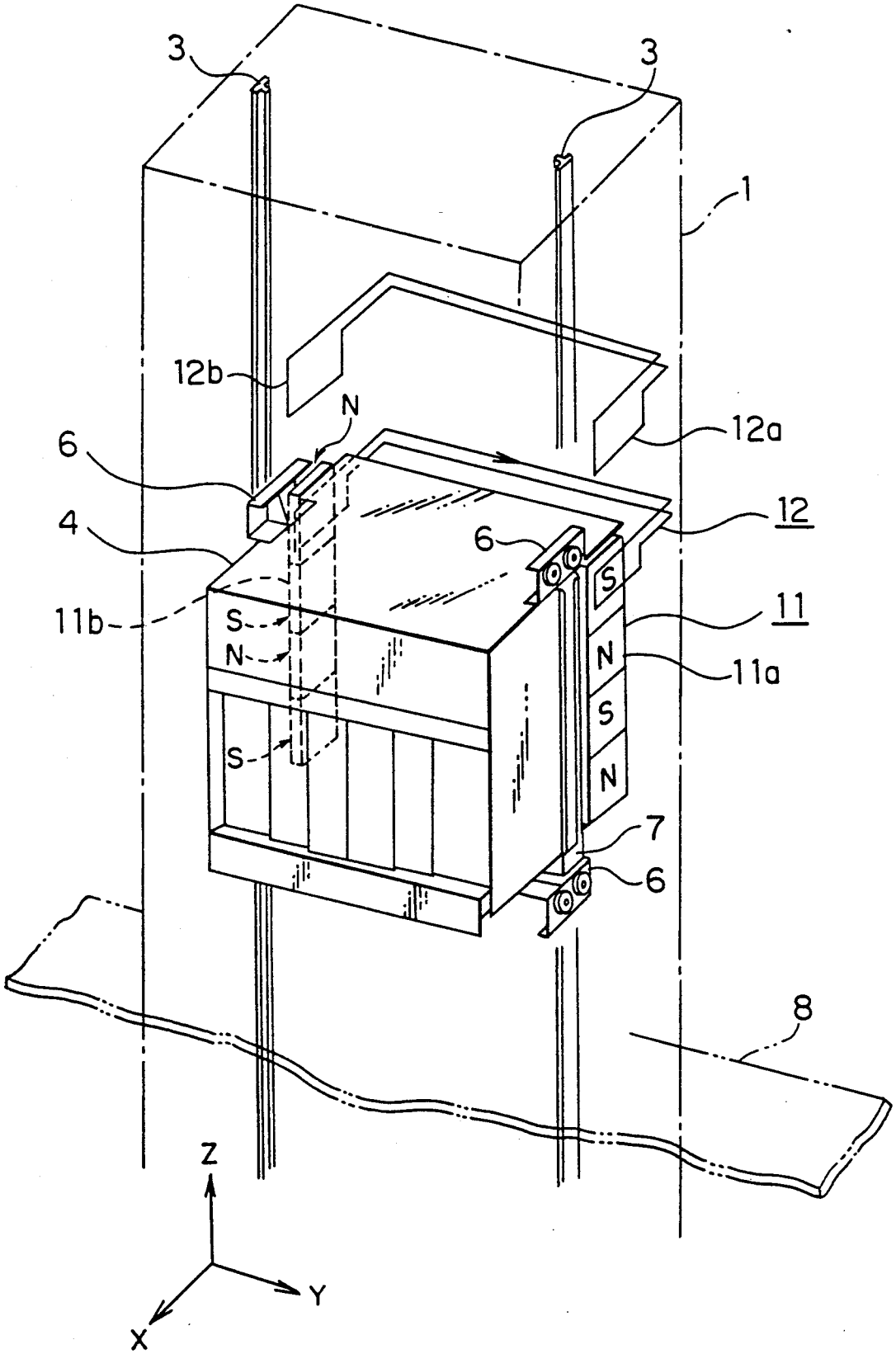
FIG. 2 is a schematic perspective view of a ropeless linear motor elevator according to an embodiment of this invention.

FIG. 2 is a schematic perspective view of a ropeless linear motor elevator according to an embodiment of this invention. On the exterior side walls of the elevator car 4 are attached a plurality of permanent magnets 11 constituting the secondary side magnets. Each horizontal layer (row) of the permanent magnets 11 is divided into two magnets 11*a* and 11*b*, such that the permanent magnets 11 are arranged in two vertical columns attached on respective side walls of the elevator car 4. The polarities of the right side column magnets 11*a* alternate such that the pole surfaces facing the side wall of the hoist way 1 are S, N, S, and N, from top to bottom. Similarly, the polarities of the left side column magnets 11*b* alternate such that the pole surfaces facing the side wall of the hoist way 1 are N, S, N and S from top to bottom.

On the interior side walls of the hoist way 1 are mounted a multitude of primary side coils 12 to oppose the permanent magnets 11 on the elevator car 4 across a predetermined gap. As described below, the primary side coils 12 not only thrust vertically but also guide horizontally the elevator car 4. Each one of the primary side coils 12 has a first coil portion 12*a* opposing the first magnet 11*a* of the permanent magnets 11, and a second coil portion 12*b* opposing the second magnet 11*b* of the permanent magnets 11. The first coil portion 12*a* and the second coil portion 12*b* each form substantially a loop. The three-phase primary side coils 12 are arranged vertically on the side walls of the hoist way 1 repeatedly in the order of U-, V-, and W-phases. For simplicity, the figure shows only two of the U-phase coils. Each one of the primary side coils 12 is coupled to a power source, such that the coil parts 12*a* and 12*b* act as a pair of parallel connected coils.

The operation of the linear motor elevator of FIG. 2 is as follows. As in the conventional case, the elevator car 4 is driven along the rails 3 within the hoist way 1 by the thrust force generated by the linear synchronous motor consisting of the permanent magnets 11 and the primary side coils 12. When the right and the left gap lengths between permanent magnets 11 and the primary side coils 12 become unbalanced, that is, when the elevator car 4 is displaced along the Y-axis from the central position thereof, a circulating current flows through the primary side coils 12 opposing the permanent magnets 11 to counterbalance the variation of the magnetic flux caused by the displacement of the elevator car 4, and thus the position of the elevator car 4 is adjusted. The direction of the circulating current caused by a displacement of the elevator car 4 in the positive Y-direction is shown by an arrow in FIG. 2. When the elevator car 4 is positioned properly at the central position, no such circulating current flows through the primary side coils 12. The principle of guiding the elevator car 4 by means of the counterbalancing flux is referred to as the null-flux method.

Since the elevator car 4 is guided by means of the null-flux method, the mechanical load on the rails 3 and the guide rollers 6 can be minimized. Thus, the mechanical strength of the rails 3 and the guide rollers 6 can be safely reduced. Hence, the cost of the overall device can be reduced.

Figure 3:
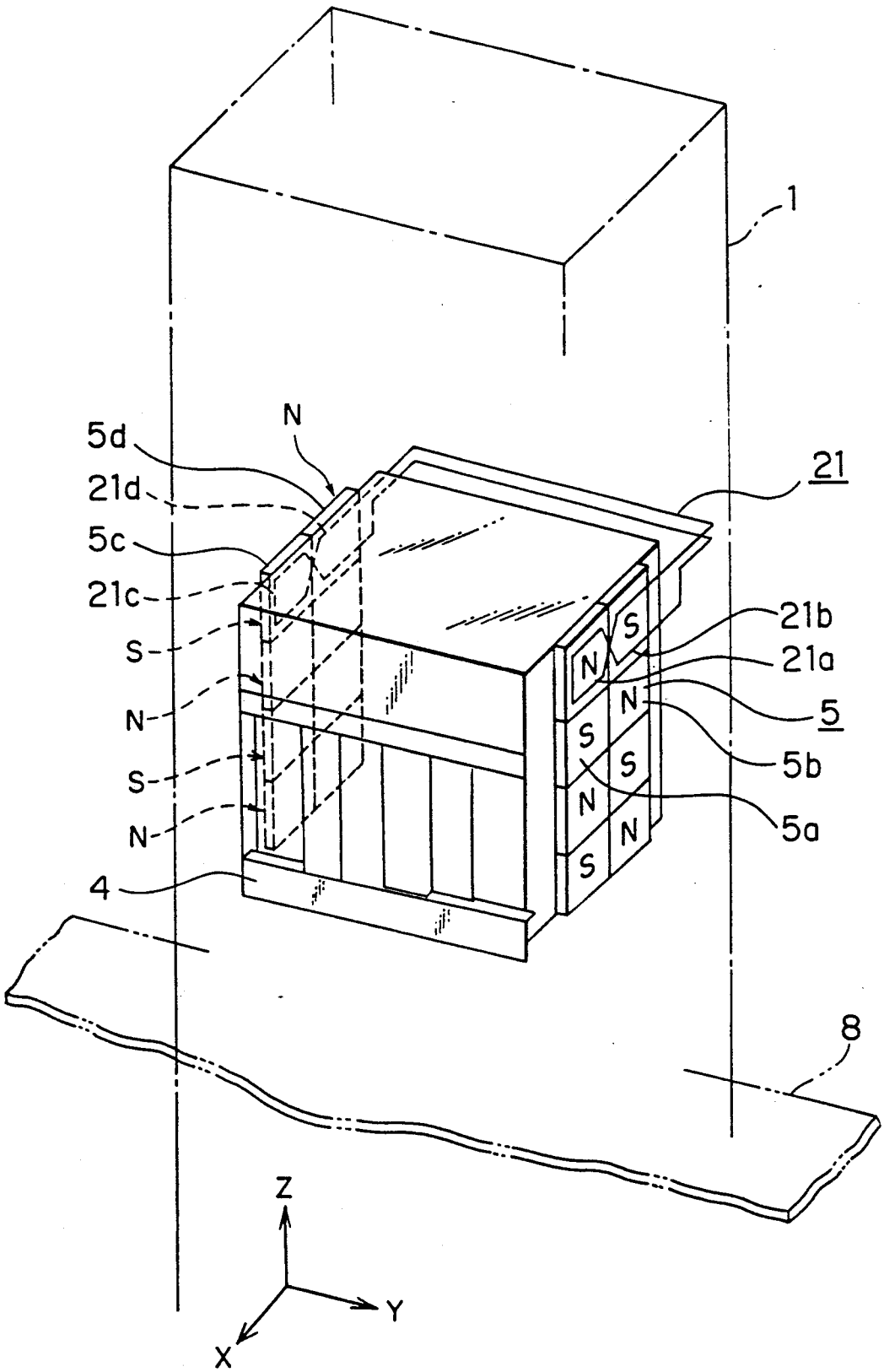
FIG. 3 is a perspective view similar to that of FIG. 2, but showing another ropeless linear motor elevator according to this invention.

FIG. 3 is a perspective view similar to that of FIG. 2, but showing another ropeless linear motor elevator according to this invention. A plurality of permanent magnets 5 are attached, as in the conventional case, on the side walls of the elevator car 4, each horizontal layer of the permanent magnets 5 being divided into first through fourth magnets 5*a* through 5*d*. The polarity of the pole surfaces of the magnets, as viewed from without, alternates both vertically and horizontally. Thus, the pole surfaces of the first vertical column magnets 5*a* opposing the side wall of the hoist way 1 are N, S, N, S, from top to bottom; the pole surfaces of the second vertical column magnets 5*b* opposing the side wall of the hoist way 1 are S, N, S, N, from top to bottom; the pole surfaces of third vertical column magnets 5*c* opposing the side wall of the hoist way 1 are S, N, S, N, from top to bottom; and the pole surfaces of the fourth vertical column magnets 5*d* opposing the side wall of the hoist way 1 are N, S, N, S, from top to bottom.

On the interior side walls of the hoist way 1 are mounted a multitude of primary side coils 21 to oppose the permanent magnets 5 on the elevator car 4 across a predetermined gap. As in the case of the first embodiment, the primary side coils 21 not only thrust vertically but also guide horizontally the elevator car 4. Each one of the primary side coils 21 has first through fourth coil portions 21*a* through 21*d* opposing the first through fourth magnets 5*a* through 5*d*, respectively. The coil portions 21*a* through 21*d* each substantially form a loop. Each one of the primary side coils 21 is twisted 180 degrees between the first coil portion 21*a* and second coil portion 21*b* and between the third coil portion 21*c* and fourth coil portion 21*d*, such that the direction of the current is inverted thereat. The primary side coils 21 are arranged vertically on the side walls of the hoist way 1 repeatedly in the order of U-, V-, and W-phases. For simplicity, the figure shows only one of the U-phase coils. Each one of the primary side coils 21 is coupled at its center to a power source.

The elevator car 4 of the ropeless linear motor elevator of FIG. 3 is guided by the null-flux method along the X-direction as well as along the Y-direction. Thus, the horizontal position of the elevator car 4 is automatically adjusted when the elevator car 4 is displaced in either the X- or Y-direction. Consequently, the rails 3 and the guide rollers 6 can be dispensed with altogether, and hence the number of parts and the overall cost can be reduced. Further, the installation of the elevator car 4 is greatly facilitated.

When a braking device 7 such as that shown in FIG. 2 is utilized, rails 3 and guide rollers 6 become necessary. However, the attachment accuracy of the rails 3 can be reduced, and hence their mounting is rendered easier.

Figure 4:
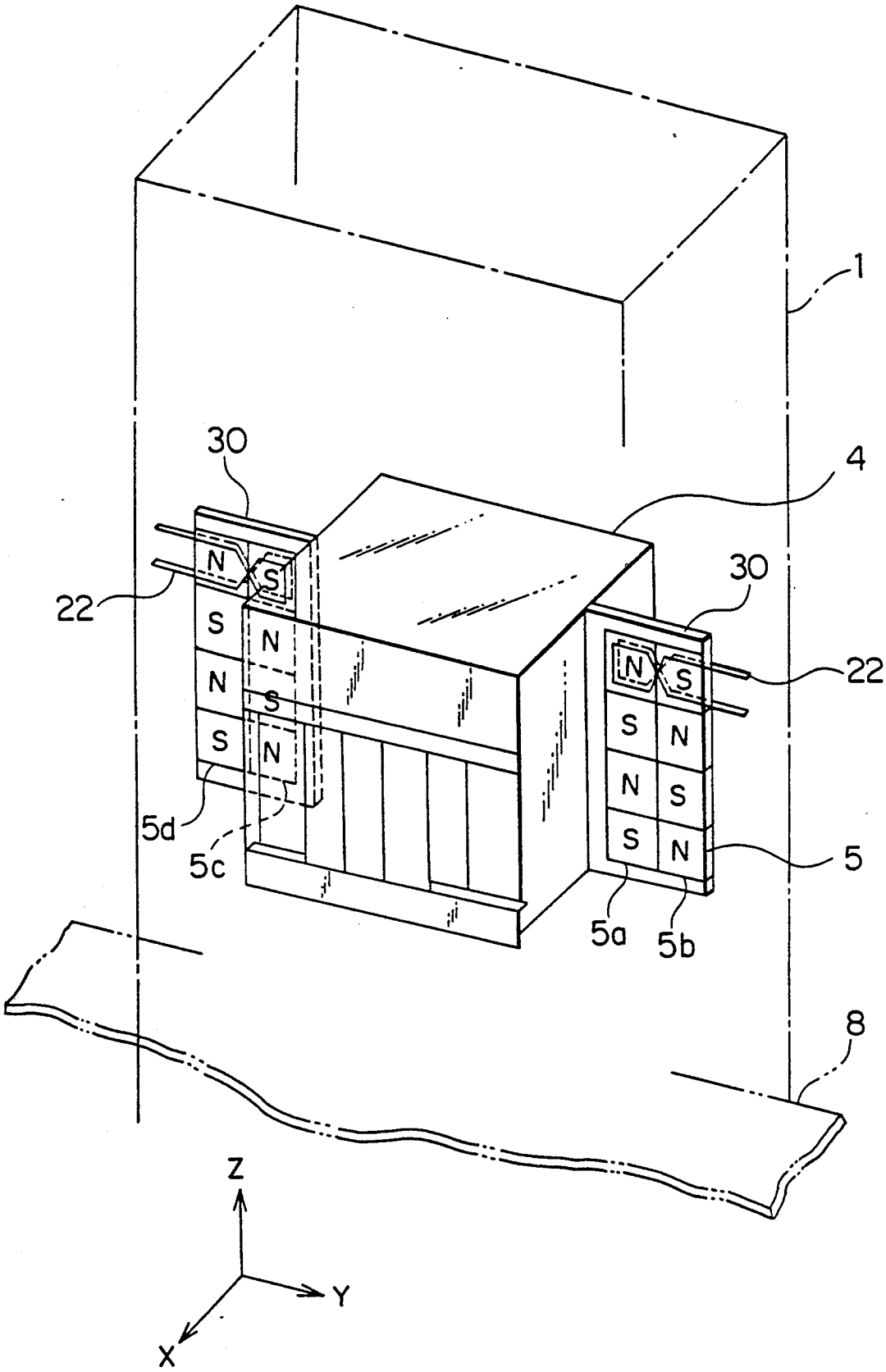
FIG. 4 is a perspective view similar to that of FIG. 2, but showing still another ropeless linear motor elevator according to this invention.

FIG. 4 is a perspective view similar to that of FIG. 2, but showing still another ropeless linear motor elevator according to this invention. A plurality of permanent magnets 5 having their pole axis arranged along the X-direction are supported by a pair of wing-shaped support members 30 attached at right angles on the side walls of the elevator car 4. The permanent magnets 5 are arranged in four vertical columns 5*a* through 5*d*, the first and the second columns 5*a* and 5*b* being mounted on the right support wing 30 and the third and the fourth columns 5*c* and 5*d* being mounted on the left support wing 30. A plurality of primary side coils 22, only a U-phase coil of which is shown in the figure, are mounted on the interior side walls of the hoist way 1 to sandwich therebetween the permanent magnets 5 across small gaps. The right and the left half of each one of the primary side coils 22 are twisted 180 degrees between the first and the second columns and the third and fourth columns of the permanent magnets 5, the polarity of which alternate both horizontally and vertically, as shown in the figure. Thus, the elevator car 4 is guided by means of the null-flux method both in the X- and Y-directions. Furthermore, since the attractive forces acting on the permanent magnets 5 from the primary side coils 22 do not act directly on the cage structure of the elevator car 4, the mechanical strength of the elevator car 4 can be reduced without sacrificing safety.

In the above embodiments, the secondary side magnets of the linear synchronous motor consist of the permanent magnets. However, the secondary side magnets may consist of electromagnets. Further, although the above embodiments relate to ropeless linear motor elevators, this invention is applicable to roped-type linear motor elevators as well. In such case, the linear motor may be disposed either at the side of the elevator car or the counterweight, which is suspended at the end of the main rope opposite to the end to which the cage is suspended. As is well known, in the case of the roped-type elevator, the elevator car and the counterweight are suspended within the hoist way at the respective ends of a main rope wound around a sheave or pulley, such that the counterweight balances the weight of the elevator car.

Further, in the above embodiments, the primary side coils are mounted on the hoist way 1, while the permanent magnets constituting the secondary side magnets are mounted on the elevator car 4 or the hoisted body. However, the primary side of the linear motor may be mounted on the hoisted body, the secondary side being mounted on the hoist way. In addition, although the primary side coils of the above embodiments serve as the guide coils in accordance with the null-flux method, separate loop-shaped guide coils may be disposed on the linear motor elevator of FIG. 1.

What is claimed is:

1. A linear motor elevator device for hoisting a hoisted body up and down within a hoist way by means of a linear motor, comprising:

primary side coils of a linear motor mounted on a side wall of said hoist way along a hoist path of the hoisted body, the primary side coils generating a magnetic field moving along the hoist way; and secondary side magnets of the linear motor attached to a side of said hoisted body to oppose said primary side coils across a gap, whereby said moving magnetic field generated by the primary side coils drive said hoisted body within the hoist way;

wherein upon displacement of the hoisted body along a direction perpendicular to a hoisting direction of the hoisted body a circulating current which counterbalances a variation of magnetic flux caused by the displacement of the hoisted body flows through said primary side coils, thereby automatically adjusting a position of the hoisted body along said direction perpendicular to the driving direction.

2. A linear motor elevator device as claimed in claim 1, wherein upon displacement of the hoisted body along either of two directions perpendicular to a driving direction of the hoisted body a circulating current which counterbalances a variation of magnetic flux caused by the displacement flows through said primary side coils, thereby automatically adjusting the position of the hoisted body along either of the two directions of displacement of said hoisted body.

3. A linear motor elevator device as claimed in claim 1, wherein said secondary side magnets comprise permanent magnets.

4. A linear motor elevator device as claimed in claim 1, wherein said secondary side magnets are arranged in a plurality of vertical columns each consisting of a plurality of magnets and polarities of said secondary side magnets alternate vertically in each column and horizontally across said plurality of columns.

* * * * *